United States Patent [19]

Berman

[11] 4,047,466

[45] Sept. 13, 1977

[54] PROJECTILE FALL-BACK PREVENTION MEANS

[75] Inventor: Allen Berman, Dover, N.J.

[73] Assignee: The United States of America as represented by the Secretary of the Army, Washington, D.C.

[21] Appl. No.: 709,837

[22] Filed: July 29, 1976

[51] Int. Cl.[2] ..... F42B 31/00

[52] U.S. Cl. ..... 89/14 R; 102/93

[58] Field of Search ..... 42/76; 89/1.703, 1.806, 89/14 R; 102/93, 94

[56] References Cited

U.S. PATENT DOCUMENTS

| | | | |
|---|---|---|---|
| 648,243 | 4/1900 | Dawson et al. | 102/93 |
| 1,207,995 | 12/1916 | Patten | 89/14 R |
| 1,380,358 | 6/1921 | Cooke | 89/1.703 |
| 2,456,011 | 12/1948 | Musser | 102/93 |
| 3,084,600 | 4/1963 | Walker | 102/93 |
| 3,089,388 | 5/1963 | Webster et al. | 102/93 |
| 3,754,726 | 8/1973 | Rusbach | 89/1.806 |

*Primary Examiner*—Stephen C. Bentley
*Attorney, Agent, or Firm*—Nathan Edelberg; A. Victor Erkilla; Thomas R. Webb

[57] ABSTRACT

In a breech-loading gun loaded by first ramming a projectile into the gun barrel to a firing position therein and then inserting a separate propelling charge, unlimited fall-back of the projectile from the firing position is prevented by means of an annular internal groove in the barrel providing a forwardly-facing shoulder, a rearwardly-facing shoulder carried by the projectile, and resilient means for automatically moving the projectile shoulder outwardly into abutting relation with the barrel shoulder on rearward movement of the projectile from its firing position. In one embodiment, the projectile shoulder is the rear end of a resilient strip extending rearwardly and outwardly from the projectile. In another embodiment, the projectile shoulder is the rear side of a radially-movable spring-biased detent on the projectile.

9 Claims, 7 Drawing Figures

PROJECTILE FALL-BACK PREVENTION MEANS

GOVERNMENTAL INTEREST

The invention described herein may be manufactured, used and licensed by or for the Government for governmental purposes without the payment to me of any royalty thereon.

BACKGROUND AND SUMMARY OF THE INVENTION

In breech-loading artillery guns, for example, where the gun is loaded by first ramming an explosive shell or other projectile through the breech and into the gun tube or barrel to a normal firing position and then inserting a separate propelling charge behind projectile, with a free space therebetween, friction between the projectile rotating band and barrel rifling is relied on to maintain the projectile in its firing position. When the gun is elevated, either before or after the propelling charge is inserted the projectile can unseat and fall back from its firing position, with one of two results when the gun is fired: either the propellant gases blow past the projectile leaving the projectile in the gun chamber; or the projectile jams in the barrel, causing a catastrophic explosion which can destroy the gun and its mount and kill or maim the gun crew. Projectile fallback can occur in practically any gun of 155mm size, or larger. For example, a 155mm M107 explosive shell for an M185 Howitzer cannon weighs about 97 pounds and has a length of 27 to 28 inches.

An object of the present invention is to provide means for effectively limiting the fallback of a projectile from its firing position to a harmless amount. In accordance with the invention, the gun barrel is formed with at least one forwardly-facing locking shoulder located near the rear end of the projectile in its firing position, and the projectile is provided with at least one outwardly-movable detent or other means having a rearwardly-facing locking shoulder located near the barrel shoulder, and means for automatically moving the detent into the path of the barrel shoulder, on fallback movement of the projectile from its firing position to a locking position determined by the two locking shoulders. Preferably, the barrel shoulder is provided by an internal annular recess in the forcing cone of the barrel, and the projectile detent is a rearwardly-and-outwardly-extending, resilient, flexible strip integral with a plastic obturator ring or band attached to the projectile just behind the usual rotating band thereon. On the other hand, the projectile detent may be an outwardly-movable, spring-pressed detent plunger slidably mounted in an outwardly-open recess in the projectile.

DETAILED DESCRIPTION OF PREFERRED EMBODIMENTS

Figure 1:
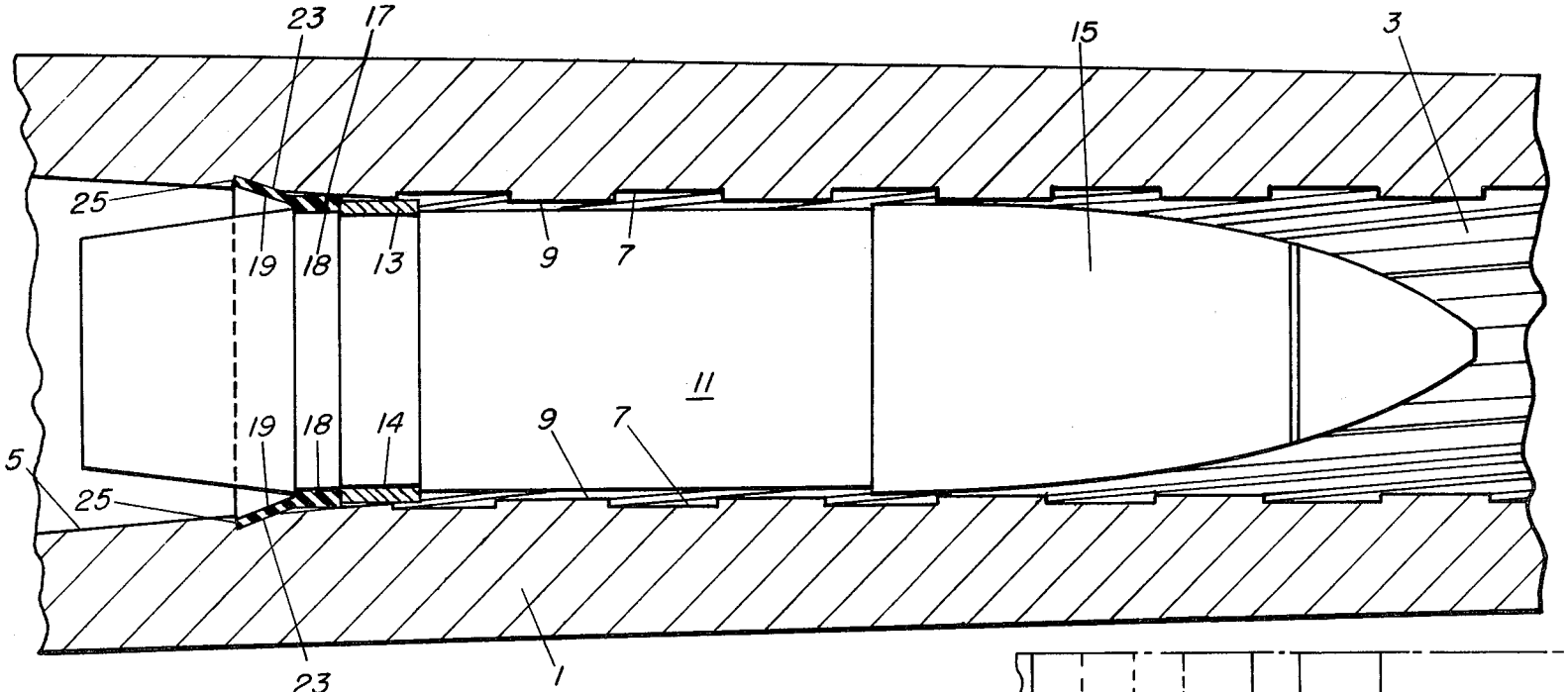
FIG. 1 is an axial section view of part of the chamber portion of a large caliber gun barrel, with a projectile located in its locking position therein, illustrating an embodiment of the invention incorporating a flanged plastic obturator on the projectile.
Figure 1A:
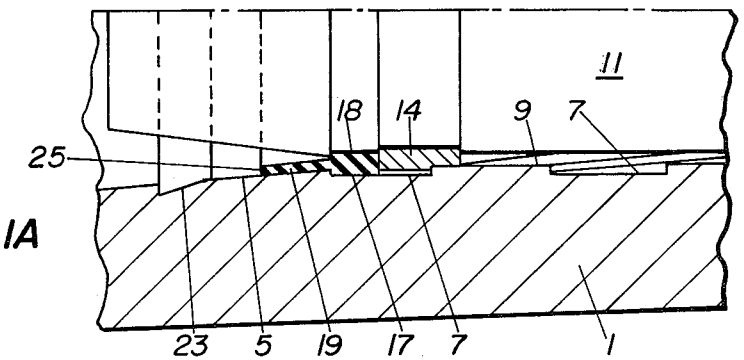
FIG. 1A is a fragmentary view, similar to FIG. 1, showing the projectile in its firing position.

Referring to FIG. 1, numeral 1 indicates a gun barrel of relatively large caliber, e.g. a 155 mm M185 Howitzer Cannon, comprising a main bore 3 and a tapered forcing cone 5 which latter forms part of an ammunition chamber for a separate propelling charge (not shown). The bore 3 is formed with conventional spiral rifling grooves 7 and intermediate rifling lands 9 which run out in the forcing cone 5. A projectile 11, e.g. a 155 mm M107 High Explosive shell having a rotating band 13, e.g. of copper, of rectangular cross-section seated in an annular recess 14, is shown in the barrel 1 in a position wherein the rotating band 13 has just engaged the tapered rear ends of the rifling lands 9, in the ramming movement of the projectile into the barrel. In the normal firing position of the projectile which is just beyond (to the right of) the position shown in FIG. 1, the projectile is frictionally held, to some extent by the pressure between the rotating band 13 and rifling lands 9. An example of the normal firing position is shown in FIG. 1A. The forward end 15 of the projectile 11 has an external diameter slightly less than the circle diameter of the rifling lands 9, for guiding the projectile through the bore 3, whereas the rotating band 13 has an external diameter slightly greater than the circle diameter of the lands (see FIG. 1A) 9, in order that the spiral lands will engrave the rotating band 13, and hence, impart spin to the projectile 11 during launch.

In the embodiment of the invention shown in FIG. 1, a plastic obturator (gas-sealing) ring or band 17, comprising a base portion 18 of rectangular cross-section and an integral resilient flexible flange or skirt 19 normally extending rearwardly and outwardly from the base 18 of the ring 17, is mounted in a shallow annular recess 21 in the projectile 11 next to the rear side of rotating band 13. The barrel 1 is formed with an internal annular groove 23, having a rear wall which provides a forwardly-facing shoulder 25. The groove 23 is located in the forcing cone 5 in a location to receive the flange 19 when the projectile is in the position shown in FIG. 1.

In the normal loading of the projectile 11 into the barrel, the projectile is rammed by conventional means (not shown), through the locking position shown in FIG. 1, to its normal firing position therebeyond, shown in FIG. 1A. As the rear end of the flange 19 passes the shoulder 25 the flange incidentally springs outwardly into the groove 23. However, if the projectile should fall back from its normal firing position, e.g. caused by elevating the gun barrel, the resilient flange 19 springs outwardly into the groove 23, thus locking the projectile against further rearward movement.

As well-known in the art it is sometimes necessary to remove a projectile 11 from the barrel after it has been rammed into place therein e.g. as a result of a misfire. To permit such removal, the plastic flange 19 is preferably designed to yield or fracture under sufficient rearward force applied to the projectile. In static tests, an obturator flange 19 such as that shown in FIG. 1 withstood a load of 4800 pounds at ambient temperature.

After being kept in a temperature conditioning box at 440° F during a period of 1 hour and 15 minutes, the flange 19 withstood a load of 600 pounds for 3 minutes. At this temperature, a 990 pound load was required to induce skirt inversion for extraction of the projectile.

Figure 2:
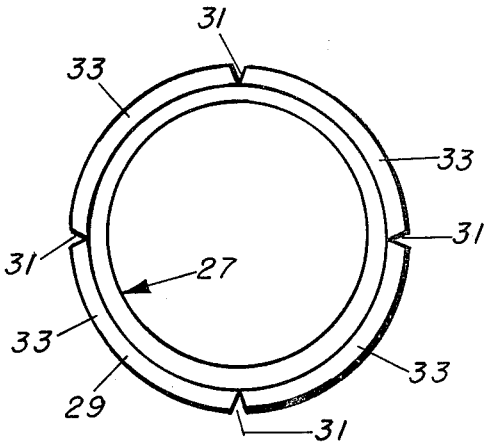
FIG. 2 is an end view of a modification of the flange obturator of FIG. 1.

FIG. 2 shows a modification of the obturator band 17 of FIG. 1 wherein a plastic band 27 has a base portion 28 and an integral flange or skirt 29 that is interrupted by a number (e.g. four, as shown) V-shaped notches 31 to form a like number of relatively independent flange segments 33, to facilitate compression of the flange 29 by the forcing cone 5 during the loading of the projectile.

In FIG. 1A, the resilient flange 19 assists the base portion 18 in providing a gas check or seal between the projectile 11 and the barrel bore 3 during normal firing of the gun. To achieve the same function, the V notches 31 of the obturator 27 in FIG. 2 should be designed to close when the projectile is in its normal firing position.

The plastic obturator 17 or 27, which is usually made of nylon, burns and/or disintegrates during firing without endangering nearby personnel. Moreover, the only change in the projectile that is required is the substitution of a flanged obturator ring for the conventional obturator ring.

Figure 4:
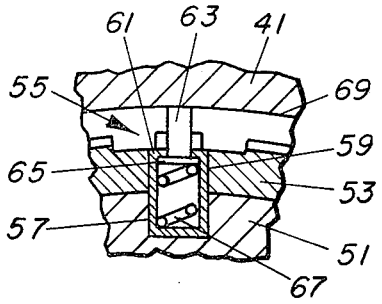
FIG. 4 is an enlarged fragmentary section view taken on the line 4—4 in FIG. 3.
Figure 3:
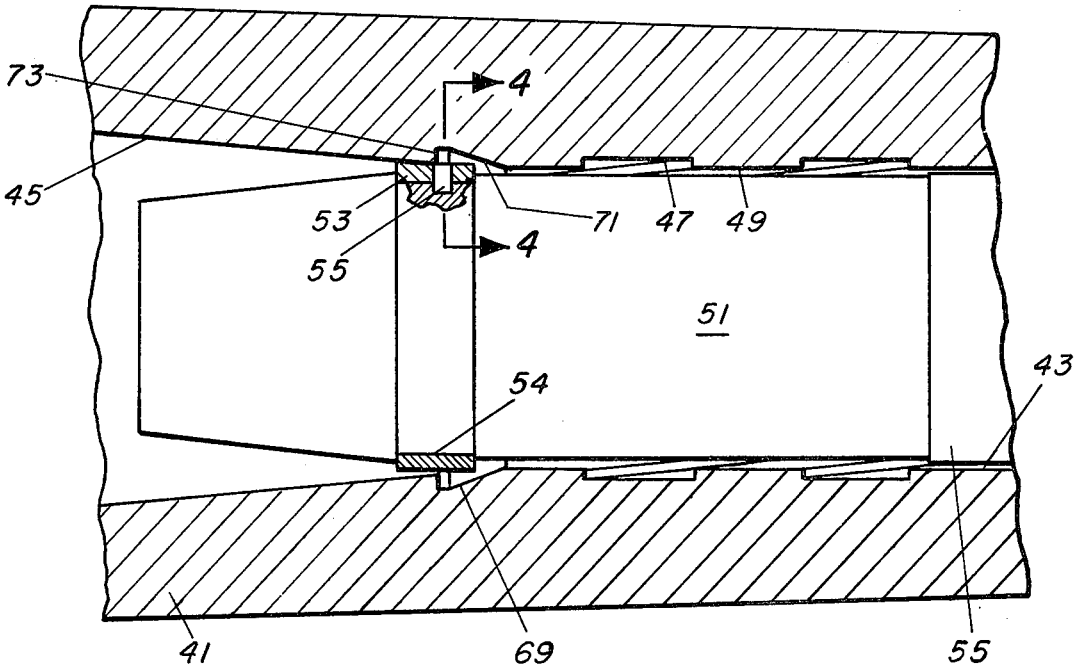
FIG. 3 is a view similar to FIG. 1 illustrating an embodiment incorporating a spring-biased detent plunger carried by the projectile.

FIGS. 3 and 4 show an embodiment of the invention utilizing a spring-biased detent for projectile fall-back prevention. A large caliber gun barrel 41, having a bore 43, a forcing cone 45, rifling grooves 47 and rifling lands 49, contains a projectile 51 having a rotating band 53 seated in an annular recess 54. The projectile is shown in a locking position just before reaching its fully-rammed, or firing, position, with the rotating band 53 spaced slightly behind the rifling lands 49.

In accordance with the invention, a detent assembly 55, mounted on the projectile 51 to prevent appreciable fall-back of the projectile assembly 55, comprises a cup-shaped metal plunger guide or holder 57 secured in a cylindrical radial recess or socket 59 formed in the rotating band 53 and projectile 51, as shown best in the FIG. 4. The holder 57 has an inturned retaining flange 61 at the open end. A detent plunger or rod 63, of metal or plastic, having an enlarged head 65 slidable radially within the holder 57, is normally biased outwardly against the flange 61 by a coil spring 67 of steel, for example.

The barrel 41 is formed with an annular internal recess 69 in position to receive the outer end of the spring-biased detent plunger 63 in the projectile position shown in FIG. 3. As in the embodiment of FIG. 1, the projectile 53 is normally rammed a short distance beyond the position shown in FIG. 3. The groove 69 includes an inclined ramp 71 at its forward side to cam the detent plunger out of the groove in its forward movement. The transverse rear wall of the groove 69 provides a forwardly-facing shoulder 73 corresponding to shoulder 25 in FIG. 1. If, after being rammed beyond the position shown, the projectile falls back, the detent plunger 61 moves outwardly, under the bias of spring 67, into the groove 69, and the movement of the projectile is stopped by engagement of the plunger with the barrel shoulder 73. Additional detent plunger assemblies may be used, especially for heavier projectiles of larger caliber guns. The detent plunger may instead by mounted in the wall of the projectile, either forward of aft of the rotating band.

Figure 5:
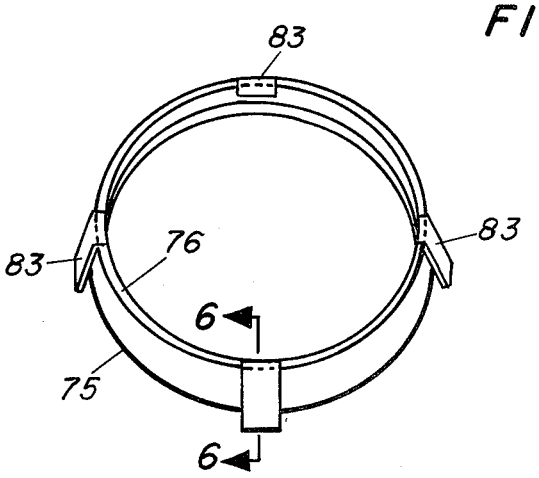
FIG. 5 is a perspective view of a another modification of the obturator ring of FIG. 1.
Figure 6:
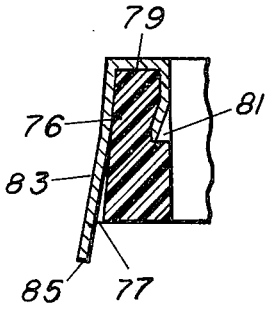
FIG. 6 is a transverse section view taken on line 6—6 of FIG. 5.

FIGS. 5 and 6 illustrate a modification wherein the all-plastic obturator ring 17 of FIG. 1 is replaced by a plastic obturator ring 75 comprising a body 76 having shallow recesses 77, 79 and 81 on three sides in which resilient flexible metal clips 83 are mounted. The free end 85 of each clip 83 engages the barrel recess 23 and shoulder 25 of FIG. 1, to limit fall-back of the projectile, in the same manner as the plastic flange 19.

The foregoing disclosure and drawings are merely illustrative of the principles of this invention and are not to be interpreted in a limiting sense. I wish it to be understood that I do not desire to be limited to the exact details of construction shown and described, because obvious modifications will occur to a person skilled in the art.

I claim:

1. In a breech-loading gun that is loaded by first ramming a projectile into the gun barrel to a firing position therein and then inserting a separate propelling charge behind the projectile, means for preventing unlimited fall-back of said projectile from said firing position, comprising:

at least one fixed forwardly-facing internal locking shoulder on said barrel;

at least one movable rearwardly-facing external locking shoulder on said projectile; said projectile shoulder being located forwardly of said barrel shoulder when said projectile is in said firing position; and resilient means for moving said projectile shoulder into abutting relation with said barrel shoulder in the event of rearward movement of said projectile from said firing position.

2. Fall-back preventing means as in claim 1, wherein said barrel shoulder is forwardly-facing wall of an internal annular recess in said barrel.

3. Fall-back preventing means as in claim 1, wherein said movable projectile shoulder is the free end of a resilient flexible member attached at its other end to, and extending rearwardly and outwardly from, said projectile, prior to insertion into said barrel.

4. Fall-back preventing means as in claim 3, wherein said member is carried by an obturator ring mounted on said projectile.

5. Fall-back preventing means as in claim 4, wherein said obturator ring is made of a plastic material and said member is an integral annular flange on said ring.

6. Fall-back prevention means as in claim 5, wherein said flange is capable of withstanding an axial force of 600 pounds at 440° F. for 3 minutes.

7. Fall-back preventing means as in claim 5, wherein said flange is interrupted by transverse notches forming a plurality of resilient flexible fingers.

8. Fall-back preventing means as in claim 4, wherein a forward portion of said barrel comprises internal spiral rifling lands and grooves for imparting spin to said projectile during launch, said projectile comprises a fixed annular rotating band thereon which frictionally engages said rifling lands in said firing position, and said obturator ring is disposed behind and abuts said rotating band.

9. Fall-back preventing means as in claim 1, wherein said movable shoulder is a portion of a spring-biased detent plunger slidably mounted in an outwardly-open recess in said projectile.

* * * * *